United States Patent [19]

O'Dell

[11] Patent Number: 4,497,329

Date of Patent: Feb. 5, 1985

[54] CIGARETTE SNUFFER

[76] Inventor: James L. O'Dell, 4711 SE. 88th Ave., Portland, Oreg.

[21] Appl. No.: 400,457

[22] Filed: Jul. 21, 1982

[51] Int. Cl.[3] ..... A24F 19/14

[52] U.S. Cl. ..... 131/235 R; 131/237; 131/256

[58] Field of Search ..... 131/235 R, 256, 237; D27/9

[56] References Cited

U.S. PATENT DOCUMENTS

| | | | |
|---|---|---|---|
| D. 106,318 | 10/1937 | Moore | D27/9 |
| D. 112,539 | 12/1938 | Schildknecht | D27/9 |
| D. 123,930 | 12/1940 | Thal | D27/9 |
| 1,883,819 | 10/1932 | Pfingst | 131/235 |
| 2,231,776 | 2/1941 | Seelinger | 131/235 |
| 2,558,320 | 6/1951 | Statelles | 131/256 |
| 2,748,778 | 6/1956 | Olson | 131/235 |
| 2,768,631 | 10/1956 | Russell | 131/235 |
| 3,386,452 | 6/1968 | Davis | 131/256 |
| 3,491,773 | 1/1970 | Herbert | 131/235 |
| 3,888,264 | 6/1975 | Baclit | 131/235 R |

FOREIGN PATENT DOCUMENTS

| | | | |
|---|---|---|---|
| 0057265 | 2/1940 | Denmark | 131/235 R |
| 2451073 | 4/1976 | Fed. Rep. of Germany | 131/235 R |
| 0714619 | 9/1931 | France | 131/235 R |

*Primary Examiner*—V. Millin

*Attorney, Agent, or Firm*—Glen A. Collett

[57] ABSTRACT

A cigarette snuffer including a cylindrical tube having therein an internal circumferential ridge for compressing the unburned material of the cigarette in order to form an air seal both around the periphery of the cigarette and in the material thereof.

4 Claims, 6 Drawing Figures

CIGARETTE SNUFFER

BACKGROUND OF THE INVENTION

This invention relates to a smoker's article, and more particularly to a snuffer for extinguishing a burning cigarette.

Previously, cigarette smokers have used various methods of extinguishing cigarettes. Perhaps the most common is to simply grind the stub of the cigarette against the bottom of an ashtray, thus fragmenting the ash and crushing the yet unburned material.

Ashtrays, particularly those in vehicles, are generally equipped with a snuffer of sorts. A flange extends inwardly from the side of the ashtray and includes a depression or a hole of smaller diameter than a cigarette. The cigarette is ground into this depression before discard of the butt into the ashtray.

The prior art shows several cigarette snuffers of the general class of the present invention. They generally include a tube or funnel of some sort into which the cigarette is inserted. They rely on crushing the end of the cigarette and/or fragmenting the ashes and/or using a heat conductive material in the snuffer whereby heat is rapidly dissipated from the burning cigarette.

A common problem with prior art methods and apparatus for extinguishing cigarettes is that on occasion a portion of the still burning ash is knocked into the ashtray whereupon it can smolder for some time. Not only is the ashtray smoke undesirable, but if the ashtray is full of butts the conditions exist for the smoldering ash to erupt into a fire in the ashtray. This is particularly hazardous in a vehicle. Some drivers, recognizing this risk, carelessly toss their buring cigarette out of the vehicle.

Accordingly, it is the general object of the present invention to provide a cigarette snuffer which is safe and very reliable.

Another object is to provide a snuffer which performs the snuffing operation quickly.

Yet another object is to provide internal ridges within the snuffer which suffocate the burning material.

Still another object is to provide a snuffer from which old ash is readily expelled.

A further object is to provide a versitle mounting for the snuffer in various ashtrays.

Still another object is to provide a snuffer which will extinguish the cigarette without destroying it, so that it may be relit.

These and other objects and advantages of the present invention and the manner in which they are achieved will be made apparent in the following specification and claims.

SUMMARY OF THE INVENTION

In its basic concept the cigarette snuffer of the present invention includes a cylindrical tube having therein an internal circumferential ridge for compressing the unburned material of the cigarette in order to form an air seal both around the periphery of the cigarette and in the material thereof.

DESCRIPTION OF THE PREFERRED EMBODIMENTS

Figure 1:
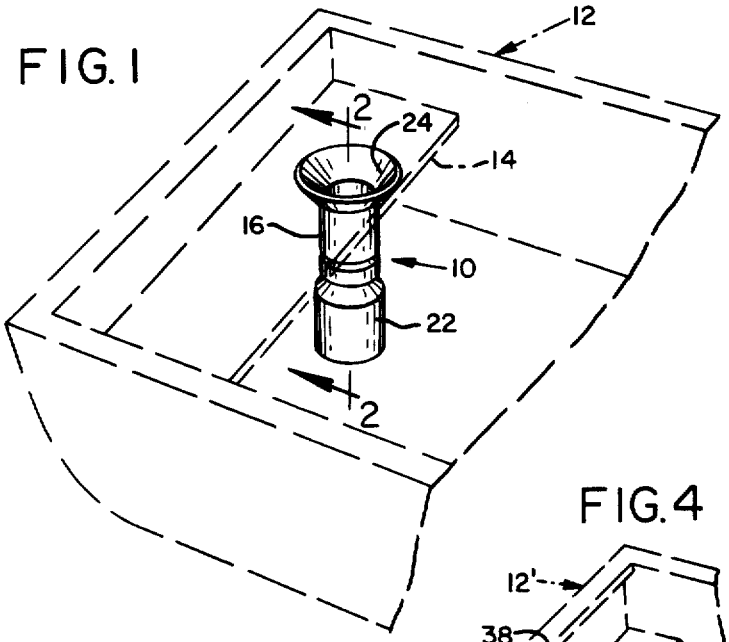
FIG. 1 is a top perspective view of the cigarette snuffer of the present invention illustrated in solid lines, and showing an ashtray (in phantom line), in which the snuffer is mounted.

As shown in FIG. 1 the cigarette snuffer of the present invention is illustrated in solid lines, generally at 10. It is mounted in an ashtray 12, which may be an ashtray of any type, however the snuffer and mountings as herein described are particularly well suited for use in an automobile ashtray. A flange 14 extends inwardly from the wall of ashtray 12 and snuffer 10 is mounted through a hole in the flange.

Figure 2:
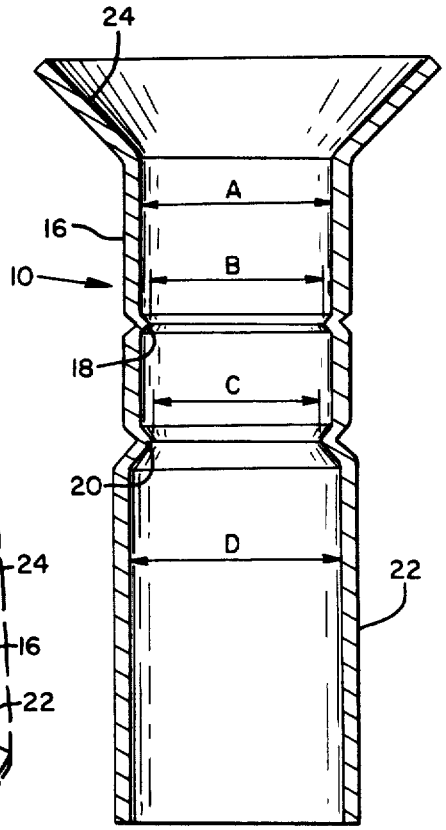
FIG. 2 is a section of the snuffer of FIG. 1 taken along the line 2—2 of FIG. 1.

FIG. 2 shows more particularly the construction of snuffer 10. A substantially cylindrical tube 16 is of a sufficient length to act as a guide for a cigarette. The tube is internally dimensioned to snugly receive the cigarette. Standard cigarettes are generally of a uniform diameter, regardless of manufacturer, nevertheless, the snuffer of the present design is able to accommodate minor variations in the diameter of cigarettes. Dimension A is the diameter of the cylindrical tube, and is approximately 5/16 inch in diameter.

An internal, circumferential ridge 18 is formed on the inside of cylindrical tube 16. The circumferential ridge constricts the bore of the tube and is dimensioned to compress the unburned material of an inserted cigarette.

A second internal, circumferential ridge 20 also serves the same purpose of compressing the unburned material of the cigarette, however the relative difference in size allows the two circumferential ridges to perform still different functions as hereinafter described.

The ridges 18 and 20 may be formed by pressing the material of tube 16 inwardly as illustrated, or they may be molded or otherwise formed in any expedient manner.

The first circumferential ridge 18 constricts the bore of tube 16 to approximately 19/64 inch in diameter, or 1/64 inch less than the nominal diameter of the tube, as illustrated by dimension B.

The second circumferential ridge 20, illustrated by dimension C, constricts the bore still further to approximately 17/64 inch.

Below the second internal circumferential ridge 20 the tube is belled at 22 to form an extension approximately 11/32 inch in diameter as denoted by dimension D. Ash in this section of the snuffer is readily expelled out the open bottom.

The upper end of the snuffer includes a funnel or flare 24 attached to the cylindrical tube to facilitate insertion of the cigarette.

Of course it must be realized that the above dimensions are relative only to cigarettes of the approximate size range stated. Even so, deviations of up to 1/64 inch greater or smaller in any of the dimensions are acceptable and do not hinder the functions of the apparatus, so long as the relative dimensions remain substantially constant.

Any large scale deviation, however, such as adapting the snuffer for cigars or the like, would require an entirely different dimensional construction, although the principles remain the same.

Figure 3:
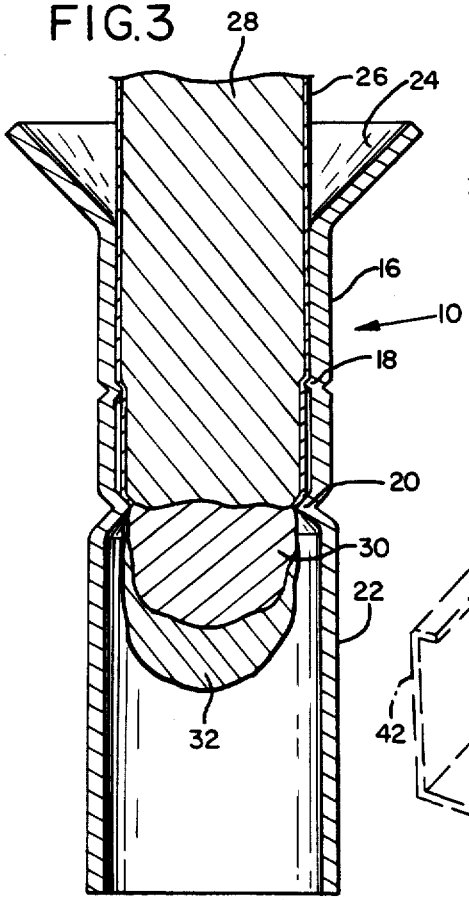
FIG. 3 is a section similar to FIG. 2 illustrating an inserted cigarette.

FIG. 3 illustrates the snuffer 10 of FIG. 2 into which a burning cigarette has been inserted. Cigarette paper 26 confines tobacco or similar material 28 in a cylindrical stick. Upon burning, the end of the cigarette forms a button 30 which is a relatively hard, glowing ember, the actual burning part of the cigarette. The non-combustible residue of the cigarette material is left over as ash 32. In general terms, the button and the ash are referred to collectively as ash.

Upon insertion of the cigarette into the snuffer the first ridge 18 compresses the unburned material, but allows it to pass therethrough, thus forming a distance adjacent the end of the cigarette where the material is compressed. This compression is sufficient to restrict the flow of air in the material, thus the burning ember cannot advance into this area.

The second ridge 20 is sufficiently more pronounced to act as a stop for the unburned material, but does allow the ash to pass therethrough. This crimps the very end of the cigarette as is illustrated.

The burning ember or button 30 quickly uses up available fuel and oxygen and is smothered. This is accomplished practically instantaneously, in no case more than a few seconds.

Any of the ash 32 or button 30 which falls off in the snuffer is readily expelled out belled end 22.

Figure 4:
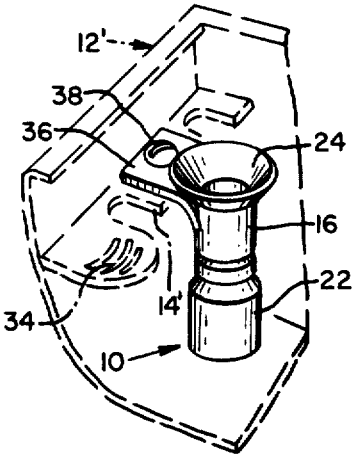
FIG. 4 is a top perspective view illustrating a second mounting assembly.

FIG. 4 illustrates a second embodiment of a mounting means for securing the snuffer 10 in an ashtray 12'. A flange 14' as is common in automobile ashtrays extends inwardly from the wall of ashtray 12'. A prior art example of a snuffer is illustrated at 34, it being a depression in flange 14' having small holes in the bottom thereof.

A tab 36 is provided, attached to cylindrical tube 16, and laps flange 14'. A fastener means such as bolt 38 secures the snuffer assembly onto the flange. Thus it can be seen that the snuffer of the present invention can be readily retrofitted to an existing ashtray.

Figure 5:
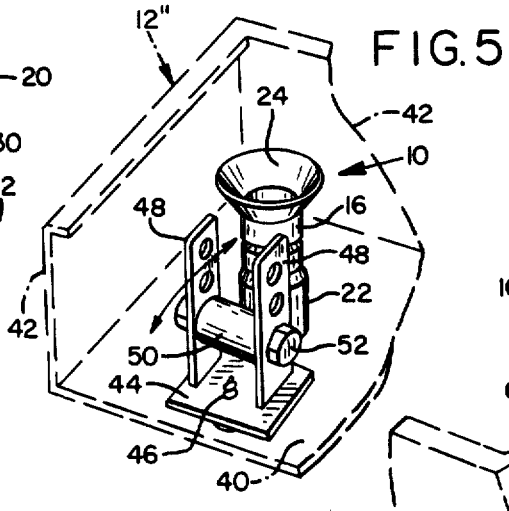
FIG. 5 is a top perspective view illustrating a third mounting assembly.

FIG. 5 illustrates a third embodiment of a mounting means. An ashtray 12'' includes a bottom 40 and upstanding walls 42. Being an automobile ashtray its depth is limited to the height of the opening into which it slides. The height may not be sufficient to accommodate an upstanding snuffer 10. Accordingly, a pivoted mounting is provided to rotate the snuffer from vertical to horizontal, thereby allowing sufficient room to operate the ashtray normally.

A bracket, including a base 44 is secured to the bottom 40 of ashtray 12' by an adhesive (not shown). Additionally, as desired and as space accommodates, a screw 46 secures the base to the ashtray. A pair of standards 48 are mounted on the base and extend upwardly. Each includes a plurality of holes for adjustment. A bushing 50, attached to snuffer 10, is mounted pivotally between the standards by a bolt 52. Thus the snuffer is operable to pivot between a substantially vertical position and a substantially horizontal position as indicated by the arrows.

Figure 6:
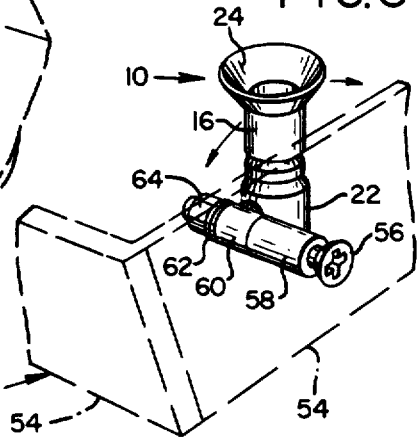
FIG. 6 is a top perspective view illustrating a fourth mounting assembly.

FIG. 6 illustrates a fourth embodiment of the mounting means. A pivotal mounting bracket is provided similar to that of FIG. 5. An ashtray 12''' includes walls 54. A bolt 56 through a hole in one of the walls supports a spacer 58 and a bushing 60 which is attached to snuffer 10. A compressible washer 62 and a nut 64 tighten the assembly. Thus the snuffer is able to pivot in the directions of the arrows.

It can be readily seen that an improved and novel cigarette snuffer is provided by the present invention. The snuffer is effective and reliable, suffocating a cigarette almost instantaneously. It is not prone to being jammed or plugged. The various mountings described allow the snuffer either to be manufactured in or retrofit into most any ashtray. It is especially useful in that a cigarette may be crushed into it, but does not necessarily have to be to effectively extinguish it. The circumferential ridges force the cigarette to smother itself by compressing the cigarette material in a circumferential manner.

Having described my invention in its preferred embodiments, I claim:

1. A cigarette snuffer for extinguishing a burning cigarette, comprising a substantially cylindrical tube internally dimensioned to snugly receive the cigarette, the tube including an internal circumferential ridge constricting the bore of the tube and dimensioned to compress the unburned material of the inserted cigarette.

2. The cigarette snuffer of claim 1 wherein the internal circumferential ridge is dimensioned to allow the unburned portion of the cigarette to pass therethrough, and to compress the unburned material sufficiently to restrict the flow of air in the material.

3. The cigarette snuffer of claim 1 wherein the internal circumferential ridge is dimensioned to allow the burned material to pass therethrough, but to act as a stop for the unburned material.

4. A cigarette snuffer for extinguishing a burning cigarette, comprising a substantially cylindrical tube internally dimensioned to snugly receive the cigarette, the tube including a first internal circumferential ridge dimensioned to allow the unburned portion of the cigarette to pass therethrough, and to compress the unburned material sufficiently to restrict the flow of air in the material, and a second internal circumferential ridge dimensioned to allow the burned material to pass therethrough, but to act as a stop for the unburned material.

* * * * *